US005649608A

United States Patent [19]

Sakakibara

[11] Patent Number: 5,649,608

[45] Date of Patent: Jul. 22, 1997

[54] LOAD TRANSPORT LIFTER

[75] Inventor: Yuuji Sakakibara, Hekinan, Japan

[73] Assignee: Bishamon Industries Corporation, Ontario, Calif.

[21] Appl. No.: 352,605

[22] Filed: Dec. 9, 1994

[30] Foreign Application Priority Data

Dec. 17, 1993 [JP] Japan ..... 5-067478

[51] Int. Cl.[6] ..... B66F 9/06

[52] U.S. Cl. ..... 187/231; 187/234; 187/244

[58] Field of Search ..... 187/244, 243, 187/269, 253, 255, 412, 224, 231, 234, 238

[56] References Cited

U.S. PATENT DOCUMENTS

| | | | |
|---|---|---|---|
| 2,918,143 | 12/1959 | Shaffer | 187/234 X |
| 3,072,219 | 1/1963 | Olson | 187/234 X |
| 3,077,951 | 2/1963 | Ramsey | 187/234 X |
| 3,208,556 | 9/1965 | Shaffer | 187/234 X |
| 4,559,840 | 12/1985 | Sasaki | 187/244 X |
| 5,351,787 | 10/1994 | Hoch et al. | 187/253 |

FOREIGN PATENT DOCUMENTS

| | | | |
|---|---|---|---|
| 49-70657 | 6/1974 | Japan . | |
| 61-130597 | 8/1986 | Japan . | |
| 63-202598 | 5/1988 | Japan . | |
| 971031 | 9/1964 | United Kingdom | 187/244 X |

*Primary Examiner*—William E. Terrell
*Assistant Examiner*—Khoi H. Tran
*Attorney, Agent, or Firm*—Antonio R. Durando

[57] ABSTRACT

A load transport lifter having the following characteristics: a lift platform with a moveable base frame connected to a cylinder mechanism and struts; upper sprockets are attached to the end of the piston rod of the cylinder mechanism and lower sprockets are attached to a lift mechanism disposed along the struts; a cable or chain, one end of which is fixed to the lift platform, is wound around the upper and lower sprockets and is fixed at the other end to the top of the struts; further, coil springs are attached to the lift mechanism and adapted to push it downward; finally, a locking mechanism is adapted to lock the lift mechanism in a set position.

15 Claims, 4 Drawing Sheets

LOAD TRANSPORT LIFTER

BACKGROUND OF THE INVENTION

1. Industrial Application

This application relates to a load transport lifter having a moveable base frame with a lift table coupled to a cylinder mechanism and vertical struts; the lift table can be raised or lowered by cables coiled around sprockets on the end of the cylinder mechanism.

2. Description of Related Art

The related art includes the apparatus described in Japanese Publication No. 130597 (1988), which consists of a fork-shaped lift platform supported horizontally by parallel scissor links disposed on top of a moveable base frame. One end of a pair of chains is fixed to the moveable base frame, while the other end is wrapped around sprockets at the end of piston rods in a cylinder set disposed vertically with respect to the moveable base frame and connected to the base of the lift platform. The lift platform moves up or down along with the piston rods and the action of the chains.

Other work platforms are disclosed in Japanese Publications No. 70657 (1974) and No. 202598 (1988). These have a self-leveling load platform mounted horizontally on a movable base frame; the load platform, through springs and electrical or mechanical means, adjusts its position to the amount of load and automatically maintains an optimum height for unloading and loading activities.

The objective of the first type of lifter disclosed above is mainly as a transport apparatus to transport loads loaded onto a pallet, or loads loaded directly onto the lifter platform. This being the case, little consideration is given to unloading of loads when the lifter is in a fixed position, thus leaving the adjustment of the height of the pallet or lifter platform solely to the discretion of the operator.

Conversely, the objective of the second type of load platform is to improve the process of unloading loads, therefore making the apparatus unsuited for transporting loads. Depending on the condition of the floor, the load may become unstable; in addition, if the load should fall from the load platform, the resilience of the springs would make the platform suddenly move upwards, making stability and safety difficult to maintain. Further, when using a pallet to transport loads, if the amount of the load were to exceed the resilience of the springs, the pallet would come into contact with the floor and the lifter would become unable to move. Finally, since the highest height reachable by the lifter platform is limited, almost no reduction in the effort required for loading and unloading from high places can be expected.

Therefore, due to the differences of purpose and function of the prior-art lifters and load platforms, it is impossible to conduct a series of operations with a lifter involving both transporting and loading/unloading and also using a lifter as a work platform. At present these functions are performed separately according to the kind of work involved.

SUMMARY OF THE INVENTION

The purpose of this invention is provide both functions of a transport lift and a work platform in a single lifter.

The invention consists of a load transport lifter having the following characteristics: a lift platform with a moveable base frame connected to a cylinder mechanism and struts; upper sprockets are attached to the end of the piston rod of the cylinder mechanism and lower sprockets are attached to a lift mechanism disposed along the struts; a cable or chain, one end of which is fixed to the lift platform, is wound around the upper and lower sprockets and is fixed at the other end to the top of the struts; further, coil springs are attached to the lift mechanism and adapted to push it downward; finally, a locking mechanism is adapted to lock the lift mechanism in a set position.

As used herein, the terms cable and chain also refer to rope and wire; likewise, the term sprocket includes chain wheels and pulleys.

In operation, when used for transporting, the lift mechanism of the invention is locked by a lock device, maintaining the table at a set position. Through the up and down movement of the sprockets that accompanies the operation of the cylinder mechanism, the lift platform is raised and lowered. When used as a load platform, the lift mechanism lock is disengaged; thus, the lift mechanism, through the action of the coil springs, is pushed downwards and the balance between the load on the lift bed and the coil springs automatically maintains the lift bed at the desired height.

BRIEF DESCRIPTION OF THE DRAWINGS

Implementation of the design of this invention is explained below based on the attached drawings.

DETAILED DESCRIPTION OF THE PREFERRED EMBODIMENT

Figure 1:
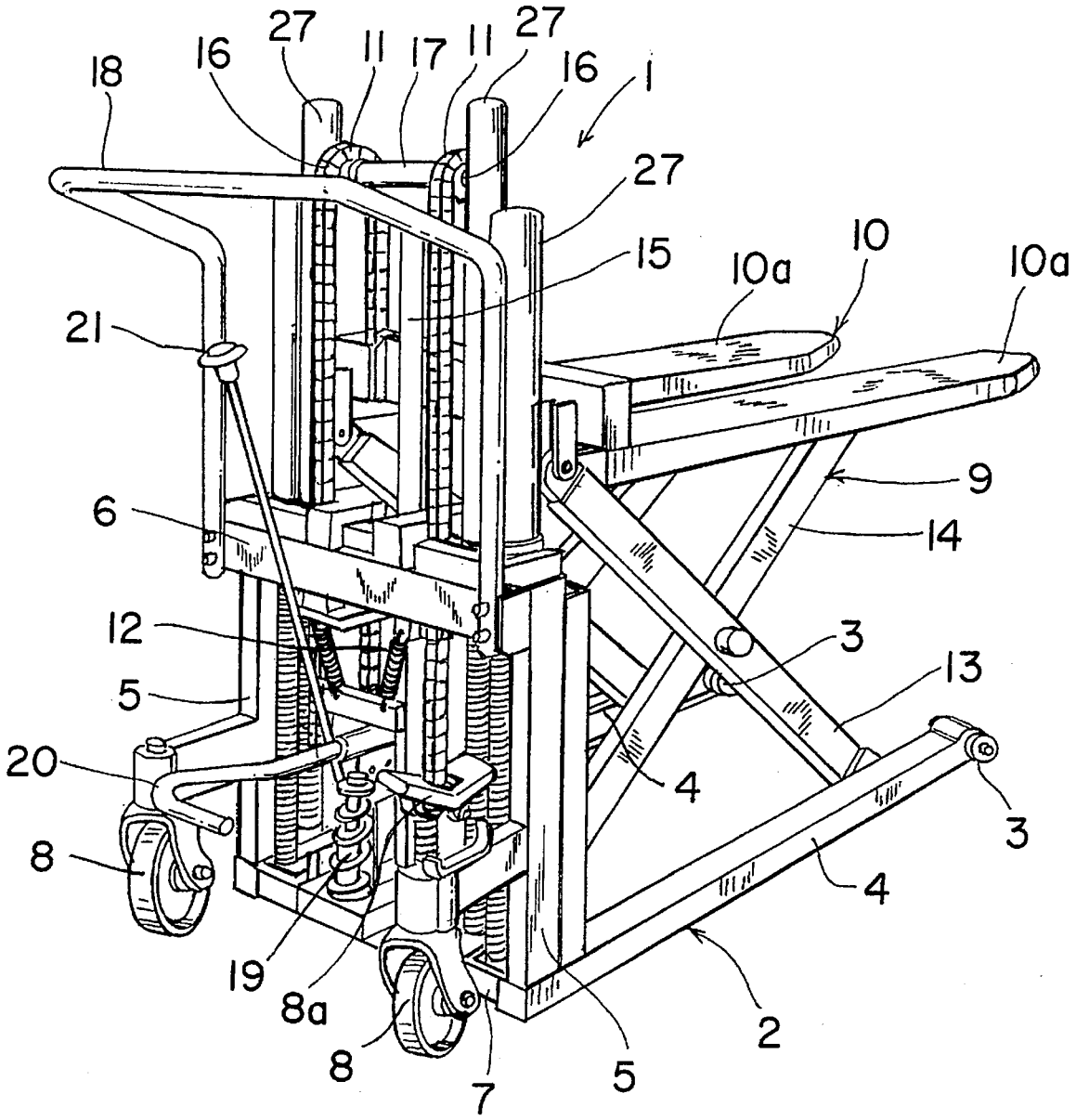
FIG. 1 is a full drawing of the transport load lifter disclosed in the present application.

FIG. 1 shows the load transport lifter of the invention. At the front end, each of a pair of rollers 3 is supported by one of a pair of longitudinal bottom frames 4. A vertical strut 5 connects the back end of each longitudinal bottom frame 4 to a transverse horizontal frame 6; and a transverse bottom frame 7, parallel to frame 6, braces the back ends of the two longitudinal bottom frames 4. Casters 8 (one of which has a brake mechanism 8*a* attached thereto) are mounted on the back ends of the vertical struts 5, thereby forming a movable base frame 2. Parallel scissor-link mechanisms 9 connect the movable base frame on the left and right to forwardly-projecting tables 10*a*, which comprise forks 10 adapted to be raised and lowered by a pair of chains 11 and a cylinder mechanism 12.

Each of the parallel scissor-link mechanisms 9 that support the aforementioned forks 10 is made of a pair of support links 13 and 14 connected in X configuration. One end of links 13 is hinged to the moveable base frame 2 and one end of links 14 is hinged to the projecting tables 10*a*. The other ends of the support links are connected to rollers (not shown in the figure), the upper rollers being coupled to tracks in the inner side of the forwardly projecting tables 10*a* and the bottom rollers to tracks in the inner side of the bottom frame 4, whereby these ends of each link are adapted to move longitudinally.

Figure 2:
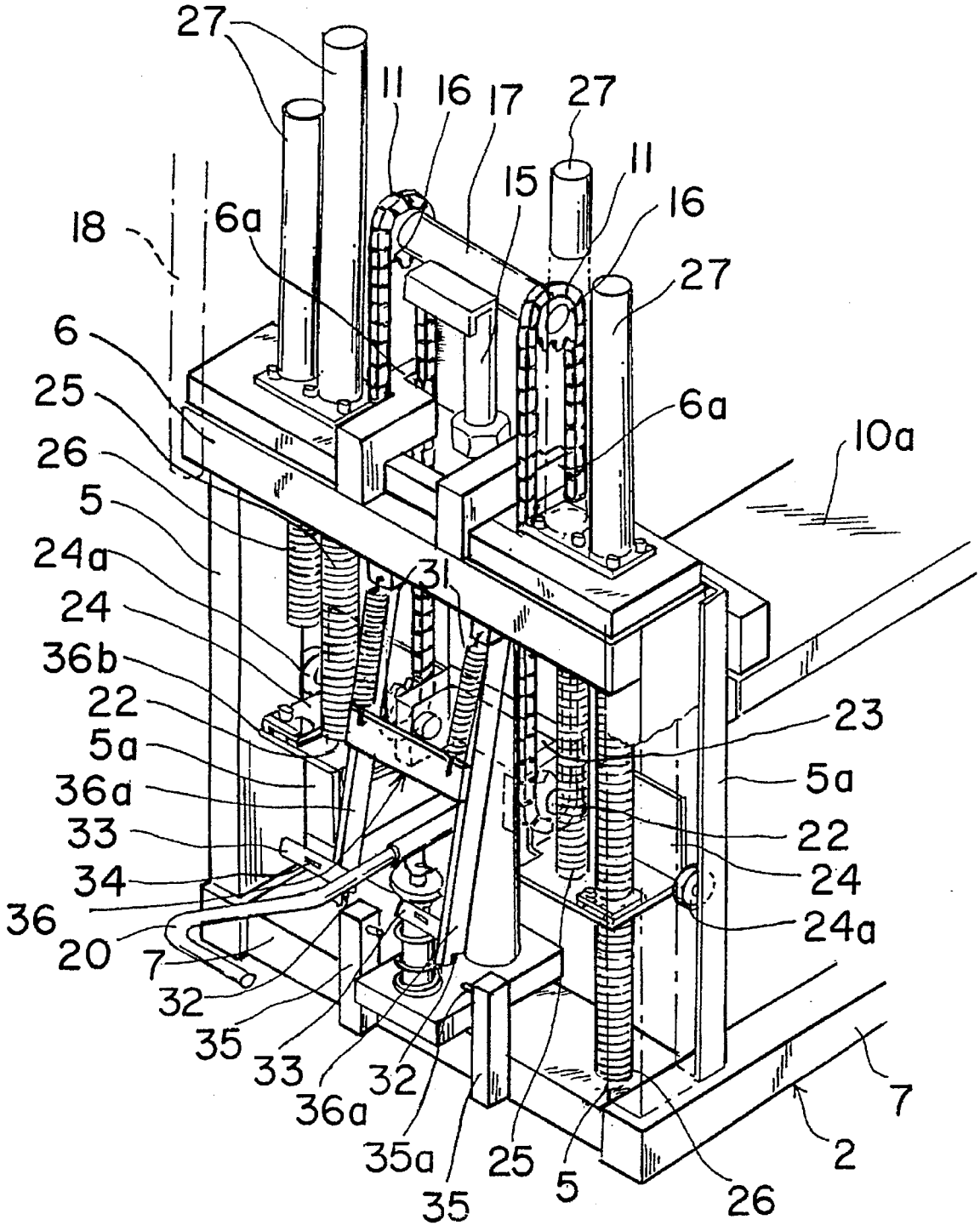
FIG. 2 is an explanatory rear view of the transport load lifter of FIG. 1.

As also illustrated in FIG. 2, the cylinder mechanism 12 which allows the forks 10 to rise and descend is rigidly anchored vertically at the center of the transverse bottom frame 7. Sprockets 16 are mounted on the left and right of the top of a piston rod 15 and a revolving axle 17 attached to these sprockets 16 is adapted to rotate freely. One end of each chain 11 is connected to the base of the aforementioned forks 10, each chain is wound around a sprocket 16, and the other end is fixedly anchored (see below), so that the forks 10 are raised and lowered by the upward and downward translation of the revolving axle 17 and the attendant movement of each chain 11. The lifter further comprises a handle 18; a plunger pump 19 that supplies operating oil to the inside of the cylinder mechanism 12 to raise the forks 10; a foot pedal 20 that operates the plunger pump; and a valve knob 21 that releases oil from the cylinder mechanism 12 to lower the forks 10.

Figure 5:
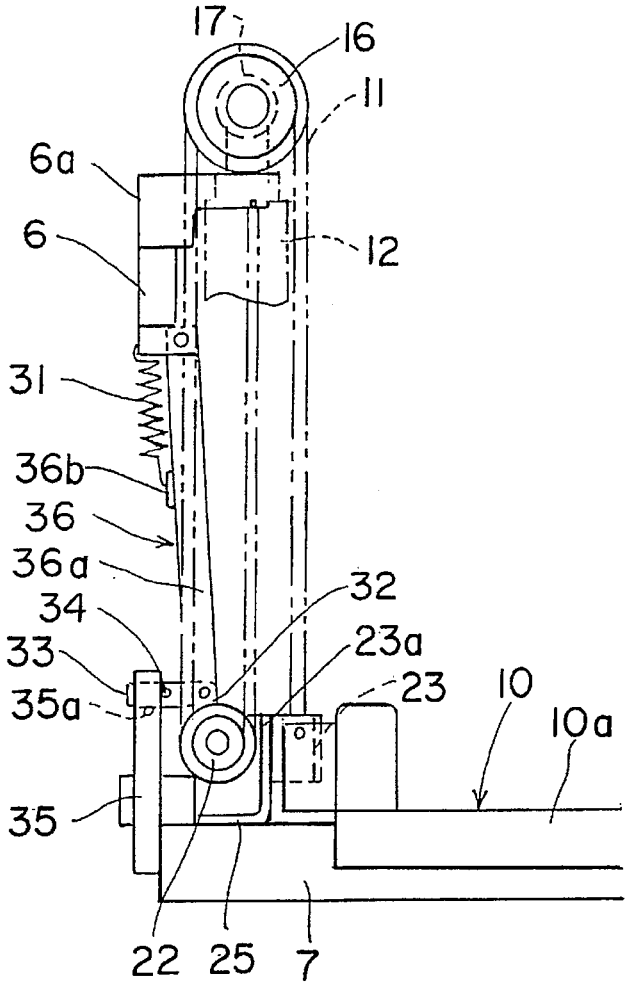
FIG. 5 is a schematic diagram showing the stop bar engaged and the lifter used as a transport lifter.

FIG. 2 is a detailed representation of the back portion of the lifter of the invention (omitting the casters 8, the valve knob 21, and other details). As also seen in FIG. 5, the chains 11 have one end connected to the base of forks 10, are coiled around sprockets 16, lowered vertically and coiled again around secondary sprockets 22 positioned directly under sprockets 16, and finally raised vertically to a point of attachment on a plate 6*a* on the horizontal frame 6. The secondary sprockets 22 are rotatably connected to two side panels 23*a* of a horizontal U-shaped lift mechanism 23 that straddles the cylinder mechanism 12 and is movably mounted between the transverse horizontal frame 6 and bottom frame 7. L-shaped wings 24 extend transversely on each side of the lift mechanism 23 and, at the outer edge of each, comprise a roller 24*a* guided by a vertical L-shaped guide structure 5*a* within each strut 5. The lift mechanism 23, along with the two wings 24, is thus guided up an down along struts 5.

Figure 3:
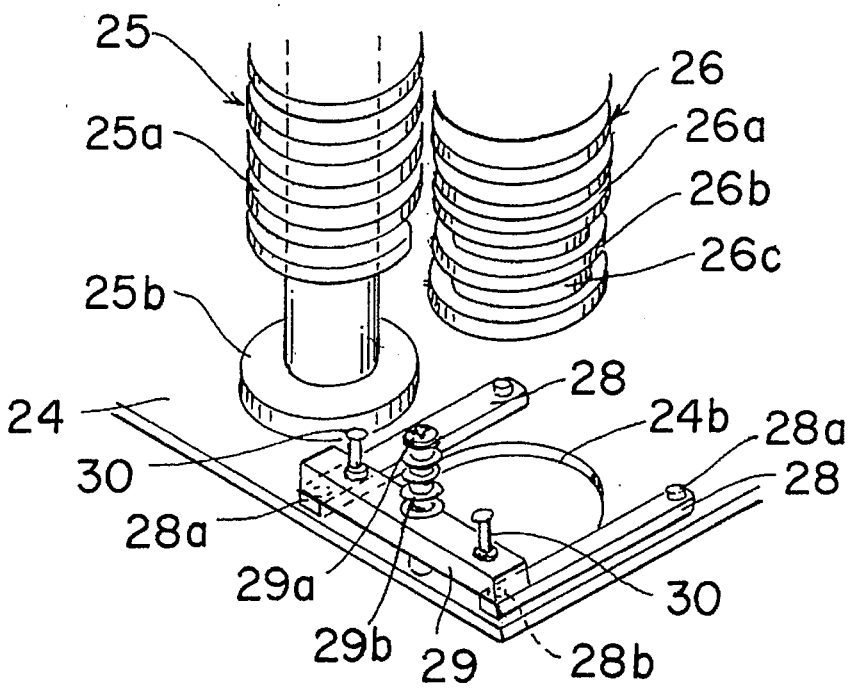
FIG. 3 is an explanatory drawing of the structure linking the springs and the wings.

Furthermore, the lift mechanism 23 is connected to the transverse frames 6 and 7 by means of two spring assemblies 25 and 26 pressing the left and right wings 24 downward. As shown in FIG. 3, these spring assemblies consist of compression springs 25*a* and 26*a* mounted on cylindrical spring supports 27 (FIG. 2) disposed to extend above frame 6. The upper ends of each spring 25*a* and 26*a* are accommodated within spring receptacles (not shown) in frame 6. The exposed lower end of each spring 25*a* is compressed by a stopper 25*b* in the support 27 attached to the wing 24 of the lift mechanism 23, while springs 26*a* pass through holes 24*b* in wings 24. Similarly, spring stoppers 26*b* are configured to rest on the upper surface of bottom frame 7.

Figure 4:
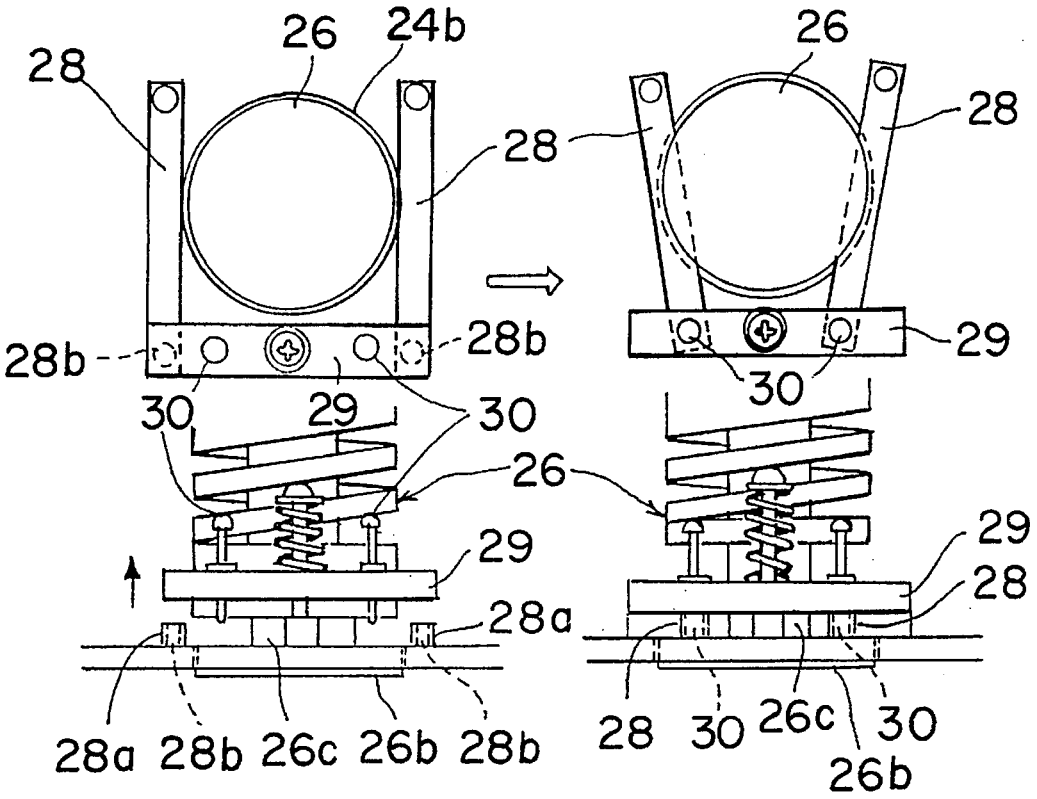
FIG. 4 is a drawing to explain the operation of the linking structure between the springs and the wings.

A pair of connectors 28 with ends 28*a* hinged to the top of wing 24 is mounted on each side of holes 24*b* through which the spring assemblies 26 pass. A stop rod 29 is also mounted on each wing 24 through a vertical screw 29*a* and is compressed downward by a spring 29*b*. As FIG. 4 illustrates, when the stop rod 29 is lifted against spring 29*b*, the perforated ends 28*a* of connectors 28 are free to swing towards the center of the hole 24*b*, and the ends of two pins 30 passing through the stop rod 29 may be inserted into the ends 28*b* to lock each connector 28 to the stop rod 29 while inserted in a groove 26*c* formed above the spring stopper 26*b*. Thus, each wing 24 and spring assembly 26 can be connected as one piece.

The preferred design is for the pair of inner springs 25 to be stronger than the pair of outer springs 26.

Further, a pair of stop levers 36*a* with a transverse stop bar 36 attached thereto is hinged to the bottom face of the horizontal frame 6. The stop bar 36 and the stop levers 36*a* are coupled to the frame 6 by means of two coil springs 31 stretched between connectors 36*b* (see also FIG. 5) and points of attachment near the pivot point of each stop lever 36*a*. As seen in FIG. 5, when the stop levers 36*a* are rotated towards the cylinder mechanism 12, they engage the two side panels 23*a* of the aforementioned lift mechanism 23, forming a point of contact 32 with the two side panels 23*a*. A lock arm 33 with a receiving slot 34 is hinged to and extends outwardly from the base of each stop lever 36*a* and can be used to engage a pin 35*a* projecting out of a vertical lock bar 35 at the back of the bottom frame 7. Thus, the lock arms 33 can be pushed towards the lift mechanism 23 to set the stop bar 36 in locked position. If the receiving slots 34 are engaged by the pins 35*a*, the backward rotation of stop bar 36 is prevented, thus locking the lift mechanism 23 in place.

When the above-described load transport lifter is used as a transport apparatus, usually the spring assemblies 25 are allowed to push the lift mechanism 23 downward to abut against the bottom frame 7 and the stop bar 36 is pushed towards the cylinder mechanism 12 to lock it in place. The point of contact 32 of each stop lever 36*a* engages a side panel 23*a* of the lift mechanism 23 and each lock arm 33 is positioned to engage a lock pin 35*a* of the lock bar 35 (FIG. 5); when this is done, as described above, through the stop bar 36 the lift mechanism 23 is maintained at a set position. When the foot pedal 20 is operated and hydraulic oil is supplied by the pump 19 to the cylinder mechanism 12, thus raising the piston rod 15, the revolving axle 17 rotates through the action of the sprockets 16 and the chains 11 are raised, thereby also lifting the forks 10. Scissor-link mechanisms 9 provide the support necessary to maintain forks 10 in a level position. When the valve knob 21 is used to release the oil pressure, the piston rod 15 is lowered and the forks 10 are lowered with it. Thus, if the lift mechanism 23 is locked, the apparatus can be used as a load transport.

Figure 6:
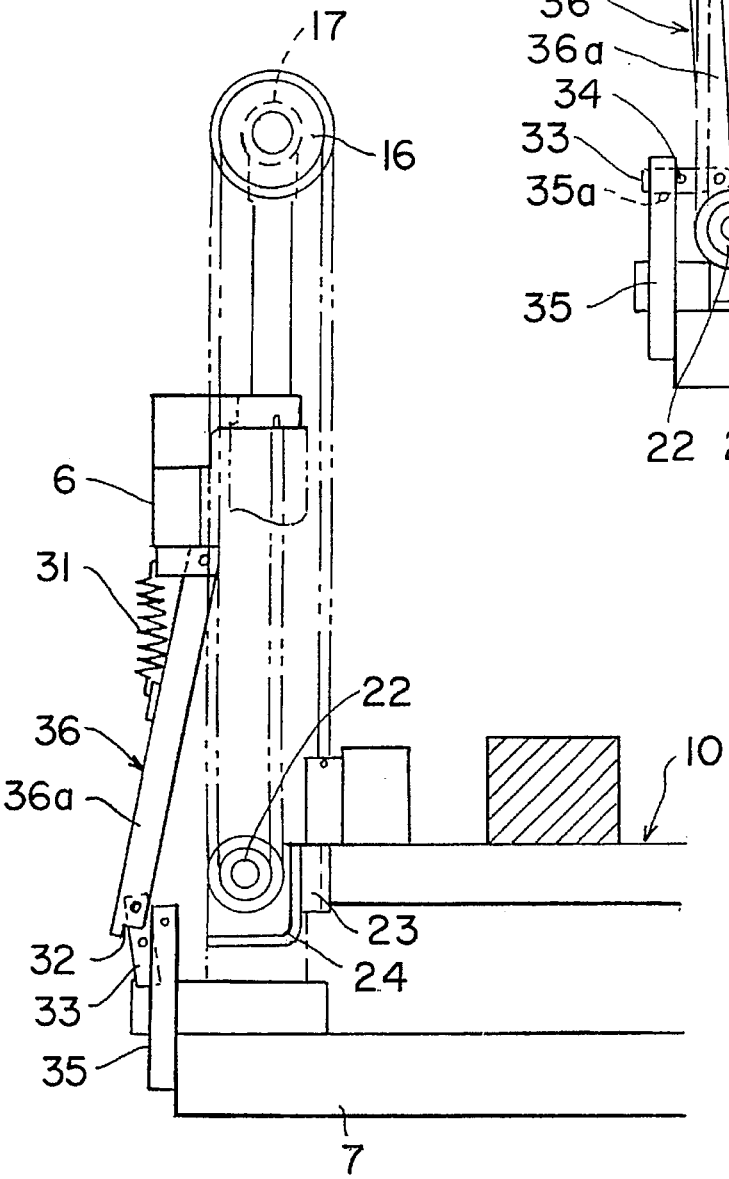
FIG. 6 is a schematic diagram showing the stop bar disengaged and the lifter used as a self-leveling load platform.

On the other hand, the load transport lifter of the invention can be used as a self-leveling loading platform. To that end, from the configuration described in FIG. 5, the lock arms 33 are rotated upward to disengage them from the lock bars 35 and the stop bar 36 is rotated backward, thereby unlocking the lift mechanism 23 (FIG. 6). Since the lift mechanism 23 is pushed towards the bottom frame 7 by a set of springs only, it is possible to select the compressive force of the springs for the work platform. In other words, when the lower spring stoppers 26*b* for the outer spring assemblies 26 are not engaged by the connectors 28 in the holes 24*b* of wings 24, the spring assemblies 26 are not connected to the wings 24 and pass through the holes 24*b* to contact the bottom frame 7. The lift mechanism 23 is thus compressed downward solely by the spring assemblies 25. Instead, when the spring stoppers 26*b* of the outer spring assemblies 26 are connected to the wings 24, the wings are compressed downward toward the bottom frame 7 by all four springs.

After choosing one or two pairs of springs for operation, the foot pedal 20 can be used to raise the sprockets 16; when no load is placed on the forks 10, the position of the lift mechanism 23 (namely the position of the secondary sprockets 22) does not vary materially while raising the forks because the compressive force of the springs pushing against wings 24 is greater than the weight of the forks 10, thus making it possible to freely set the height of the forks 10. After this step, when loads are placed on the forks 10 and the total weight exceeds half of the total compressive force of the springs in use, the lift mechanism 23 and the secondary sprockets 22 are lifted from the bottom frame 7 and at the same time the forks 10 are lowered and both stop at an equilibrium position corresponding to a balance between the resilience of the springs and the weight of the load (see FIG.

6). Since the secondary sprockets 22 rise and the forks 10 descend with each increase of the weight of the load, it is possible to use the lifter of the invention as a self-leveling work platform where the desired height is adjusted automatically to fit the load.

When operated as a self-leveling load platform as in FIG. 6, the piston rod 15 may be lowered by the operation of the valve knob 21, thus also lowering forks 10. When the lowest position is reached, the lift mechanism 23 is again pushed down to the bottom frame 7 by the compressive force of the spring and, if the stop bar 36 is set as described above, the apparatus can be used as a transport lifter to transport loads. Naturally, after transporting it can again be changed to be used as a load platform.

Through the above implementation, by lowering the forks and the secondary sprockets to the lowest position and locking and releasing the stopper, one can choose between transport-lift and load-platform modes of use; further, these functions can be utilized in succession, and the lifter can be put to many uses to fit the type of operation, type of load, and weight. Particularly when it is used as a load platform, since the secondary sprockets freely raise and lower the forks, one can freely set the position of the forks before beginning to load, or unload, to match the type of operation.

For example, when restacking loads onto a rather high place, first the lifter is used as a self-leveling load platform by placing the load on the forks 10; then it is switched to transport-lift operation and transported to the designated place. After this step, it is once more switched to load-platform operation, the cylinder mechanism 12 is actuated to raise the piston rod 15 and, so long as the load exceeds half of the springs' resilience, the position of the forks 10 remains substantially constant while the lift mechanism 23 is lifted and the springs are shortened. Therefore, the position of the forks 10 can safely be set high. When the sprockets 16 are in the highest position and the load on the forks is being taken off, gradually the forks 10 rise with a reduction in the load and reach their highest position, thereby lessening the burden of loading operations in high places.

In the present embodiment of the invention four springs are disclosed, a pair on each of the inner and outer sides, but obviously an increase or decrease in this number is possible and, if a mixture of springs with different resilience is used, wide-ranging applications for all types of loads are possible. Also, the secondary sprockets and stop-bar mechanism are not limited to the aforementioned configuration. For instance, in an alternative configuration one could fix the wings to the struts and set pull springs below the wings; or one could eliminate the wings and place guides on both sides of the lift mechanism and the secondary sprockets, fix a pull spring to the lift mechanism and provide a locking capability at an alternative position on the guides, thus being able to fulfill both objectives of the present invention, namely to use it both as a transport lift and a self-leveling load platform. Further, in the described embodiment the cylinder mechanism is placed between the two struts; if any change is introduced to the design of either strut, to the guides or to the wings, the mechanism can easily be adapted to suit the present invention.

In addition to having both the function of a transport lift and a self-leveling load platform, the present invention makes it possible to unload and transport without a break in operation by switching from one mode of operation to the other according to need, thereby lessening the operating burden. Also, in using the apparatus of the invention as a load platform, one is able to set the height of the lift platform without regard for the weight of the load, thereby improving the operation of unloading loads of different heights.

I claim:

1. An adjustable load transport lifter comprising, in combination:

(a) a frame comprising a rigid base frame adapted for movement in a substantially horizontal direction;

(b) a fork assembly connected to said base frame and adapted for substantially vertical translation;

(c) continuous cable means, having one end connected to the base frame and another end connected to the fork assembly, for directly coupling said base frame assembly and said fork assembly;

(d) first and second pulley means coupled to said cable means for providing upward and downward tension thereto;

(e) resilient means connected to said base frame for exerting a cable-means tensioning force against one of said first and second pulley means;

(f) lift means connected to said base frame for exerting a cable-means tensioning force against the other of said first and second pulley means; and (g) lock means for rigidly connecting said one of said first and second pulley means to said base frame;

wherein said resilient means, said lock means and said lift means consist of three distinct structural members.

2. An adjustable load transport lifter comprising, in combination:

(a) a frame comprising a rigid base frame adapted for movement in a substantially horizontal direction;

(b) a fork assembly connected to said base frame and adapted for substantially vertical translation;

(c) cable means, having one end connected to the base frame and another end connected to the fork assembly, for coupling said base frame assembly and said fork assembly;

(d) first and second pulley means coupled to said cable means for providing upward and downward tension thereto;

(e) resilient means connected to said base frame for exerting a cable-means tensioning force against one of said first and second pulley means;

(f) lift means connected to said base frame for exerting a cable-means tensioning force against the other of said first and second pulley means; and (g) lock means for rigidly connecting said one of said first and second pulley means to said base frame;

wherein said resilient means and said lock means are distinct structural members from said lift means, and wherein said resilient means consists of at least one spring having one end coupled to said base frame and another end coupled to said one of said first and second pulley means.

3. The device of claim 2, wherein said lift means consists of at least one piston/cylinder assembly having one end coupled to said base frame and another end coupled to said other of said first and second pulley means.

4. The device of claim 2, wherein said lock means consists of a lever mechanism adapted to alternatively prevent or allow a motion of said one of said first and second pulley means with respect to said base frame.

5. The device of claim 1, wherein said resilient means consists of at least one spring having one end coupled to said base frame and another end coupled to said one of said first and second pulley means, and wherein said lift means consists of at least one piston/cylinder assembly having one end coupled to said base frame and another end coupled to said other of said first and second pulley means.

6. An adjustable load transport lifter comprising, in combination:

(a) a frame comprising a rigid base frame adapted for movement in a substantially horizontal direction;

(b) a fork assembly connected to said base frame and adapted for substantially vertical translation;

(c) cable means, having one end connected to the base frame and another end connected to the fork assembly, for coupling said base frame assembly and said fork assembly;

(d) first and second pulley means coupled to said cable means for providing upward and downward tension thereto;

(e) resilient means connected to said base frame for exerting a cable-means tensioning force against one of said first and second pulley means;

(f) lift means connected to said base frame for exerting a cable-means tensioning force against the other of said first and second pulley means; and (g) lock means for rigidly connecting said one of said first and second pulley means to said base frame;

wherein said resilient means and said lock means are distinct structural members from said lift means, and wherein said resilient means comprises at least one permanent spring having one end coupled to said base frame and another end coupled to said one of said first and second pulley means, and further comprises at least one disengageable spring having one end coupled to said base frame and another end removably coupled to said one of said first and second pulley means.

7. The device of claim 3, wherein said resilient means consists of at least one permanent spring having one end coupled to said base frame and another end coupled to said one of said first and second pulley means, and further of at least one disengageable spring having one end coupled to said base frame and another end removably coupled to said one of said first and second pulley means.

8. The device of claim 4, wherein said resilient means consists of at least one permanent spring having one end coupled to said base frame and another end coupled to said one of said first and second pulley means, and further of at least one disengageable spring having one end coupled to said base frame and another end removably coupled to said one of said first and second pulley means.

9. The device of claim 7, wherein said lock means consists of a lever mechanism adapted to alternatively prevent or allow a motion of said one of said first and second pulley means with respect to said base frame.

10. The device of claim 2, further comprising a scissor-link mechanism comprising a first link hingedly attached to said base frame and slidably attached to said fork assembly and a second link hingedly attached to said fork assembly and slidably attached to said base frame.

11. The device of claim 5, further comprising a scissor-link mechanism comprising a first link hingedly attached to said base frame and slidably attached to said fork assembly and a second link hingedly attached to said fork assembly and slidably attached to said base frame.

12. The device of claim 6, further comprising a scissor-link mechanism comprising a first link hingedly attached to said base frame and slidably attached to said fork assembly and a second link hingedly attached to said fork assembly and slidably attached to said base frame.

13. The device of claim 7, further comprising a scissor-link mechanism comprising a first link hingedly attached to said base frame and slidably attached to said fork assembly and a second link hingedly attached to said fork assembly and slidably attached to said base frame.

14. The device of claim 8, further comprising a scissor-link mechanism comprising a first link hingedly attached to said base frame and slidably attached to said fork assembly and a second link hingedly attached to said fork assembly and slidably attached to said base frame.

15. The device of claim 9, further comprising a scissor-link mechanism comprising a first link hingedly attached to said base frame and slidably attached to said fork assembly and a second link hingedly attached to said fork assembly and slidably attached to said base frame.

* * * * *